US008275626B2

(12) United States Patent
Neuendorf et al.

(10) Patent No.: US 8,275,626 B2
(45) Date of Patent: Sep. 25, 2012

(54) APPARATUS AND A METHOD FOR DECODING AN ENCODED AUDIO SIGNAL

(75) Inventors: Max Neuendorf, Nuremberg (DE); Bernhard Grill, Lauf (DE); Ulrich Kraemer, Stuttgart (DE); Markus Multrus, Nuremberg (DE); Harald Popp, Tuchenbach (DE); Nikolaus Rettelbach, Nuremberg (DE); Frederik Nagel, Nuremberg (DE); Markus Lohwasser, Hersbruck (DE); Marc Gayer, Erlangen (DE); Manuel Jander, Erlangen (DE); Virgilio Bacigalupo, Nuremberg (DE)

(73) Assignee: Fraunhofer-Gesellschaft zur Foerderung der Angewandten Forschung E.V., Munich (DE)

( * ) Notice: Subject to any disclaimer, the term of this patent is extended or adjusted under 35 U.S.C. 154(b) by 0 days.

(21) Appl. No.: 13/004,272

(22) Filed: Jan. 11, 2011

(65) Prior Publication Data

US 2011/0202353 A1 Aug. 18, 2011

Related U.S. Application Data

(63) Continuation of application No. PCT/EP2009/004522, filed on Jun. 23, 2009.

(60) Provisional application No. 61/079,841, filed on Jul. 11, 2008, provisional application No. 61/103,820, filed on Aug. 10, 2008.

(51) Int. Cl.
*G10L 19/00* (2006.01)

(52) U.S. Cl. ..... 704/501; 704/200; 704/200.1; 704/500

(58) Field of Classification Search ..... 704/200–230, 704/500–501

See application file for complete search history.

(56) References Cited

U.S. PATENT DOCUMENTS

| | | | | |
|---|---|---|---|---|
| 6,134,518 | A | 10/2000 | Cohen et al. | |
| 7,050,972 | B2 * | 5/2006 | Henn et al. | 704/228 |
| 7,991,621 | B2 | 8/2011 | Oh et al. | |
| 8,036,394 | B1 | 10/2011 | Yonemoto et al. | |
| 2003/0004711 | A1 * | 1/2003 | Koishida et al. | 704/223 |
| 2005/0096917 | A1 | 5/2005 | Kjorling et al. | |
| 2006/0136211 | A1 | 6/2006 | Jiang et al. | |

(Continued)

FOREIGN PATENT DOCUMENTS

EP 1672618 A1 6/2006

(Continued)

OTHER PUBLICATIONS

International Search Report, mailed Jan. 11, 2010, in related PCT application PCT/EP2009/004523, 7 pages.

(Continued)

*Primary Examiner* — Douglas Godbold

(74) *Attorney, Agent, or Firm* — Michael A. Glenn; Glenn Patent Group

(57) ABSTRACT

An apparatus for decoding an encoded audio signal having first and second portions encoded in accordance with first and second encoding algorithms, respectively, BWE parameters for the first and second portions and a coding mode information indicating a first or a second decoding algorithm, includes first and second decoders, a BWE module and a controller. The decoders decode portions in accordance with decoding algorithms for time portions of the encoded signal to obtain decoded signals. The BWE module has a controllable crossover frequency and is configured for performing a bandwidth extension algorithm using the first decoded signal and the BWE parameters for the first portion, and for performing a bandwidth extension algorithm using the second decoded signal and the bandwidth extension parameter for the second portion. The controller controls the crossover frequency for the BWE module in accordance with the coding mode information.

13 Claims, 10 Drawing Sheets

U.S. PATENT DOCUMENTS

| | | | | |
|---|---|---|---|---|
| 2007/0016411 | A1 | 1/2007 | Kim et al. | |
| 2007/0106502 | A1 | 5/2007 | Kim et al. | |
| 2007/0150269 | A1 | 6/2007 | Nongpiur et al. | |
| 2007/0225971 | A1* | 9/2007 | Bessette | 704/203 |
| 2007/0282603 | A1* | 12/2007 | Bessette | 704/219 |
| 2008/0120116 | A1 | 5/2008 | Schnell et al. | |
| 2009/0076829 | A1* | 3/2009 | Ragot et al. | 704/500 |
| 2009/0110208 | A1 | 4/2009 | Choo et al. | |
| 2009/0132261 | A1* | 5/2009 | Kjorling et al. | 704/500 |
| 2009/0157413 | A1* | 6/2009 | Oshikiri | 704/501 |
| 2009/0319259 | A1 | 12/2009 | Liljeryd et al. | |
| 2010/0121646 | A1* | 5/2010 | Ragot et al. | 704/500 |
| 2010/0211399 | A1 | 8/2010 | Liljeryd et al. | |
| 2010/0286990 | A1* | 11/2010 | Biswas et al. | 704/500 |
| 2010/0286991 | A1 | 11/2010 | Hedelin et al. | |
| 2011/0173004 | A1 | 7/2011 | Bessette et al. | |
| 2011/0200198 | A1* | 8/2011 | Grill et al. | 381/23 |

FOREIGN PATENT DOCUMENTS

| | | | |
|---|---|---|---|
| EP | 2056294 | | 5/2009 |
| EP | 2077551 | A | 3/2011 |
| WO | WO00/45379 | | 8/2000 |
| WO | WO00/63887 | A1 | 10/2000 |
| WO | WO01/26095 | A1 | 4/2001 |
| WO | WO02/41302 | | 5/2002 |
| WO | WO03/046891 | | 6/2003 |
| WO | WO2004/114133 | | 12/2004 |
| WO | WO2006/000110 | | 1/2006 |
| WO | WO2008/031458 | | 3/2008 |
| WO | WO2009/081315 | | 7/2009 |

OTHER PUBLICATIONS

Int'l Preliminary Report on Patentability, mailed Jan. 11, 2011, in related PCT application PCT/EP2009/004523, 9 pages.

* cited by examiner (ENCODER)

(DECODER)

(ENCODER)

(DECODER)

APPARATUS AND A METHOD FOR DECODING AN ENCODED AUDIO SIGNAL

CROSS-REFERENCE TO RELATED APPLICATIONS

This application is a continuation of copending International Patent Application No. PCT/EP2009/004522 filed Jun. 23, 2009, and claims priority to U.S. Application No. 61/079,841, filed Jul. 11, 2008, and additionally claims priority from U.S. Application 61/103,820, filed Aug. 10, 2008, all of which are incorporated herein by reference in their entirety.

BACKGROUND OF THE INVENTION

The present invention relates to an apparatus and a method for decoding an encoded audio signal, an apparatus for encoding, a method for encoding and an audio signal.

In the art, frequency domain coding schemes such as MP3 or AAC are known. These frequency-domain encoders are based on a time-domain/frequency-domain conversion, a subsequent quantization stage, in which the quantization error is controlled using information from a psychoacoustic module, and an encoding stage, in which the quantized spectral coefficients and corresponding side information are entropy-encoded using code tables.

On the other hand there are encoders that are very well suited to speech processing such as the AMR-WB+ as described in 3GPP TS 26.290. Such speech coding schemes perform a Linear Predictive filtering of a time-domain signal. Such a LP filtering is derived from a Linear Prediction analysis of the input time-domain signal. The resulting LP filter coefficients are then coded and transmitted as side information. The process is known as Linear Prediction Coding (LPC). At the output of the filter, the prediction residual signal or prediction error signal which is also known as the excitation signal is encoded using the analysis-by-synthesis stages of the ACELP encoder or, alternatively, is encoded using a transform encoder which uses a Fourier transform with an overlap. The decision between the ACELP coding and the Transform Coded eXcitation coding which is also called TCX coding is done using a closed loop or an open loop algorithm.

Frequency-domain audio coding schemes such as the high efficiency-AAC encoding scheme which combines an AAC coding scheme and a spectral bandwidth replication technique, can also be combined to a joint stereo or a multichannel coding tool which is known under the term "MPEG surround". On the other hand, speech encoders such as the AMR-WB+ also have a high frequency enhancement stage and a stereo functionality.

Said spectral band replication (SBR) comprises a technique that gained popularity as an add-on to popular perception audio coded such as MP3 and the advanced audio coding (AAC). SBR comprise a method of bandwidth extension (BWE) in which the low band (base band or core band) of the spectrum is encoded using an existing coding, whereas as the upper band (or high band) is coarsely parameterized using fewer parameters. SBR makes use of a correlation between the low band and the high band in order to predict the high band signal from extracting lower band features.

SBR is, for example, used in HE-AAC or AAC+SBR. In SBR it is possible to dynamically change the crossover frequency (BWE start frequency) as well as the temporal resolution meaning the number of parameter sets (envelopes) per frame. AMR-WB+ implements a time domain bandwidth extension in combination with a switched time/frequency domain core coder, giving good audio quality especially for speech signals. A limiting factor to AMR-WB+ audio quality is the audio bandwidth common to both core codecs and BWE start frequency that is one quarter of the system's internal sampling frequency. While the ACELP speech model is capable to model speech signals quite well over the full bandwidth, the frequency domain audio coder fails to deliver decent quality for some general audio signals. Thus, speech coding schemes show a high quality for speech signals even at low bit rates, but show a poor quality for music signals at low bit rates.

Frequency-domain coding schemes such as HE-AAC are advantageous in that they show a high quality at low bit rates for music signals. Problematic, however, is the quality of speech signals at low bit rates.

Therefore, different classes of audio signal demand different characteristics of bandwidth extension tool.

SUMMARY

According to an embodiment, an apparatus for decoding an encoded audio signal, the encoded audio signal having a first portion encoded in accordance with a first encoding algorithm, a second portion encoded in accordance with a second encoding algorithm, BWE parameters for the first portion and the second portion and a coding mode information indicating a first decoding algorithm or a second decoding algorithm, may have: a first decoder for decoding the first portion in accordance with the first decoding algorithm for a first time portion of the encoded signal to acquire a first decoded signal, wherein the first decoder has an LPC-based coder; a second decoder for decoding the second portion in accordance with the second decoding algorithm for a second time portion of the encoded signal to acquire a second decoded signal, wherein the second decoder has a transform-based coder; a BWE module having a controllable crossover frequency, the BWE module being configured for performing a bandwidth extension algorithm using the first decoded signal and the BWE parameters for the first portion, and for performing a bandwidth extension algorithm using the second decoded signal and the bandwidth extension parameter for the second portion, wherein the BWE module is configured to use a first crossover frequency for the bandwidth extension for the first decoded signal and to use a second crossover frequency for the bandwidth extension for the second decoded signal, wherein the first crossover frequency is higher than the second crossover frequency; and a controller for controlling the crossover frequency for the BWE module in accordance with the coding mode information.

According to another embodiment, an apparatus for encoding an audio signal may have: a first encoder which is configured to encode in accordance with a first encoding algorithm, the first encoding algorithm having a first frequency bandwidth, wherein the first encoder has an LPC-based coder; a second encoder which is configured to encode in accordance with a second encoding algorithm, the second encoding algorithm having a second frequency bandwidth being smaller than the first frequency bandwidth, wherein the second encoder has a transform-based coder; a decision stage for indicating the first encoding algorithm for a first portion of the audio signal and for indicating the second encoding algorithm for a second portion of the audio signal, the second portion being different from the first portion; and a bandwidth extension module for calculating BWE parameters for the audio signal, wherein the BWE module is configured to be controlled by the decision stage to calculate the BWE parameters for a band not having the first frequency bandwidth in the first portion of the audio signal and for a band not having the second frequency bandwidth in the second portion of the audio signal, wherein the first or the second frequency bandwidth is defined by a variable crossover frequency and wherein the decision stage is configured to output the variable crossover frequency, wherein the BWE module is configured to use a first crossover frequency for calculating the BWE parameters for a signal encoded using the first encoder and to use a second crossover frequency for a signal encoded using the second encoder, wherein the first crossover frequency is higher than the second crossover frequency.

According to another embodiment, a method for decoding an encoded audio signal, the encoded audio signal having a first portion encoded in accordance with a first encoding algorithm, a second portion encoded in accordance with a second encoding algorithm, BWE parameters for the first portion and the second portion and a coding mode information indicating a first decoding algorithm or a second decoding algorithm, may have the steps of: decoding the first portion in accordance with the first decoding algorithm for a first time portion of the encoded signal to acquire a first decoded signal, wherein decoding the first portion includes using an LPC-based coder; decoding the second portion in accordance with the second decoding algorithm for a second time portion of the encoded signal to acquire a second decoded signal, wherein decoding the second portion includes using a transform-based coder; performing a bandwidth extension algorithm by a BWE module including a controllable crossover frequency, using the first decoded signal and the BWE parameters for the first portion, and performing, by the BWE module having the controllable crossover frequency, a bandwidth extension algorithm using the second decoded signal and the bandwidth extension parameter for the second portion, wherein a first crossover frequency is used for the bandwidth extension for the first decoded signal and a second crossover frequency is used for the bandwidth extension for the second decoded signal, wherein the first crossover frequency is higher than the second crossover frequency; and controlling the crossover frequency for the BWE module in accordance with the coding mode information.

According to another embodiment, a method for encoding an audio signal may have the steps of: encoding in accordance with a first encoding algorithm, the first encoding algorithm having a first frequency bandwidth, wherein encoding in accordance with a first encoding algorithm includes using an LPC-based coder; encoding in accordance with a second encoding algorithm, the second encoding algorithm having a second frequency bandwidth being smaller than the first frequency bandwidth, wherein encoding in accordance with a second encoding algorithm includes using a transform-based coder; indicating the first encoding algorithm for a first portion of the audio signal and the second encoding algorithm for a second portion of the audio signal, the second portion being different from the first portion; and calculating BWE parameters for the audio signal such that the BWE parameters are calculated for a band not having the first frequency bandwidth in the first portion of the audio signal and for a band not having the second frequency bandwidth in the second portion of the audio signal, wherein the first or the second frequency bandwidth is defined by a variable crossover frequency, wherein the BWE module is configured to use a first crossover frequency for calculating the BWE parameters for a signal encoded using the LPC-based coder and to use a second crossover frequency for a signal encoded using the transform-based coder, wherein the first crossover frequency is higher than the second crossover frequency.

According to another embodiment, a encoded audio signal may have: a first portion encoded in accordance with a first encoding algorithm, the first encoding algorithm having an LPC-based coder; a second portion encoded in accordance with a second different encoding algorithm, the second encoding algorithm having a transform-based coder; bandwidth extension parameters for the first portion and the second portion; and a coding mode information indicating a first crossover frequency used for the first portion or a second crossover frequency used for the second portion, wherein the first crossover frequency is higher than the second crossover frequency.

Another embodiment has a computer program for performing, when running on a computer, the method for encoding an audio signal, which method may have the steps of: encoding in accordance with a first encoding algorithm, the first encoding algorithm having a first frequency bandwidth, wherein encoding in accordance with a first encoding algorithm includes using an LPC-based coder; encoding in accordance with a second encoding algorithm, the second encoding algorithm having a second frequency bandwidth being smaller than the first frequency bandwidth, wherein encoding in accordance with a second encoding algorithm includes using a transform-based coder; indicating the first encoding algorithm for a first portion of the audio signal and the second encoding algorithm for a second portion of the audio signal, the second portion being different from the first portion; and calculating BWE parameters for the audio signal such that the BWE parameters are calculated for a band not having the first frequency bandwidth in the first portion of the audio signal and for a band not having the second frequency bandwidth in the second portion of the audio signal, wherein the first or the second frequency bandwidth is defined by a variable crossover frequency, wherein the BWE module is configured to use a first crossover frequency for calculating the BWE parameters for a signal encoded using the LPC-based coder and to use a second crossover frequency for a signal encoded using the transform-based coder, wherein the first crossover frequency is higher than the second crossover frequency.

The present invention is based on the finding that the crossover frequency or the BWE start frequency is a parameter influencing the audio quality. While time domain (speech) codecs usually code the whole frequency range for a given sampling rate, audio bandwidth is a tuning parameter to transform-based coders (e.g. coders for music), as decreasing the total number of spectral lines to encode will at the same time increase the number of bits per spectral line available for encoding, meaning a quality versus audio bandwidth tradeoff is made. Hence, in the new approach, different core coders with variable audio bandwidths are combined to a switched system with one common BWE module, wherein the BWE module has to account for the different audio bandwidths.

A straightforward way would be to find the lowest of all core coder bandwidths and use this as BWE start frequency, but this would deteriorate the perceived audio quality. Also, the coding efficiency would be reduced, because in time sections where a core coder is active which has a higher bandwidth than the BWE start frequency, some frequency regions would be represented twice, by the core coder as well as the BWE which introduces redundancy. A better solution is therefore to adapt the BWE start frequency to the audio bandwidth of the core coder used.

Therefore according to embodiments of the present invention an audio coding system combines a bandwidth extension tool with a signal dependent core coder (for example switched speech-/audio coder), wherein the crossover frequency comprise a variable parameter. A signal classifier output that controls the switching between different core coding modes may also be used to switch the characteristics of the BWE system such as the temporal resolution and smearing, spectral resolution and the crossover frequency.

Therefore, one aspect of the present invention is an audio decoder for an encoded audio signal, the encoded audio signal comprising a first portion encoded in accordance with a first encoding algorithm, a second portion encoded in accordance with a second encoding algorithm, BWE parameters for the first portion and the second portion and a coding mode information indicating a first decoding algorithm or a second decoding algorithm, comprising a first decoder, a second decoder, a BWE module and a controller. The first decoder decodes the first portion in accordance with the first decoding algorithm for a first time portion of the encoded signal to obtain a first decoded signal. The second decoder decodes the second portion in accordance with the second decoding algorithm for a second time portion of the encoded signal to obtain a second decoded signal. The BWE module has a controllable crossover frequency and is configured for performing a bandwidth extension algorithm using the first decoded signal and the BWE parameters for the first portion, and for performing a bandwidth extension algorithm using the second decoded signal and the bandwidth extension parameter for the second portion. The controller controls the crossover frequency for the BWE module in accordance with the coding mode information.

According to another aspect of the present invention, an apparatus for encoding an audio signal comprises a first and a second encoder, a decision stage and a BWE module. The first encoder is configured to encode in accordance with a first encoding algorithm, the first encoding algorithm having a first frequency bandwidth. The second encoder is configured to encode in accordance with a second encoding algorithm, the second encoding algorithm having a second frequency bandwidth being smaller than the first frequency bandwidth. The decision stage indicates the first encoding algorithm for a first portion of the audio signal and the second encoding algorithm for a second portion of the audio signal, the second portion being different from the first portion. The bandwidth extension module calculates BWE parameters for the audio signal, wherein the BWE module is configured to be controlled by the decision stage to calculate the BWE parameters for a band not including the first frequency bandwidth in the first portion of the audio signal and for a band not including the second frequency bandwidth in the second portion of the audio signal.

In contrast to embodiments, SBR in conventional technology is applied to a non-switch audio codec only which results in the following disadvantages. Both temporal resolution as well as crossover frequency could be applied dynamically, but state of art implementations such as 3GPP source apply usually only a change of temporary resolution for transients as, for example, castanets. Furthermore, a finer overall temporal resolution might be chosen at higher rates as a bit rate dependent tuning parameter. No explicit classification is carried out determining the temporal resolution or a decision threshold controlling the temporal resolution, best matching the signal type as, for example, stationary, tonal music versus speech. Embodiments of the present invention overcome these disadvantages. Embodiments allow especially an adapted crossover frequency combined with a flexible choice for the used core coder so that the coded signal provides a significantly higher perceptual quality compared to encoder/decoder of conventional technology.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
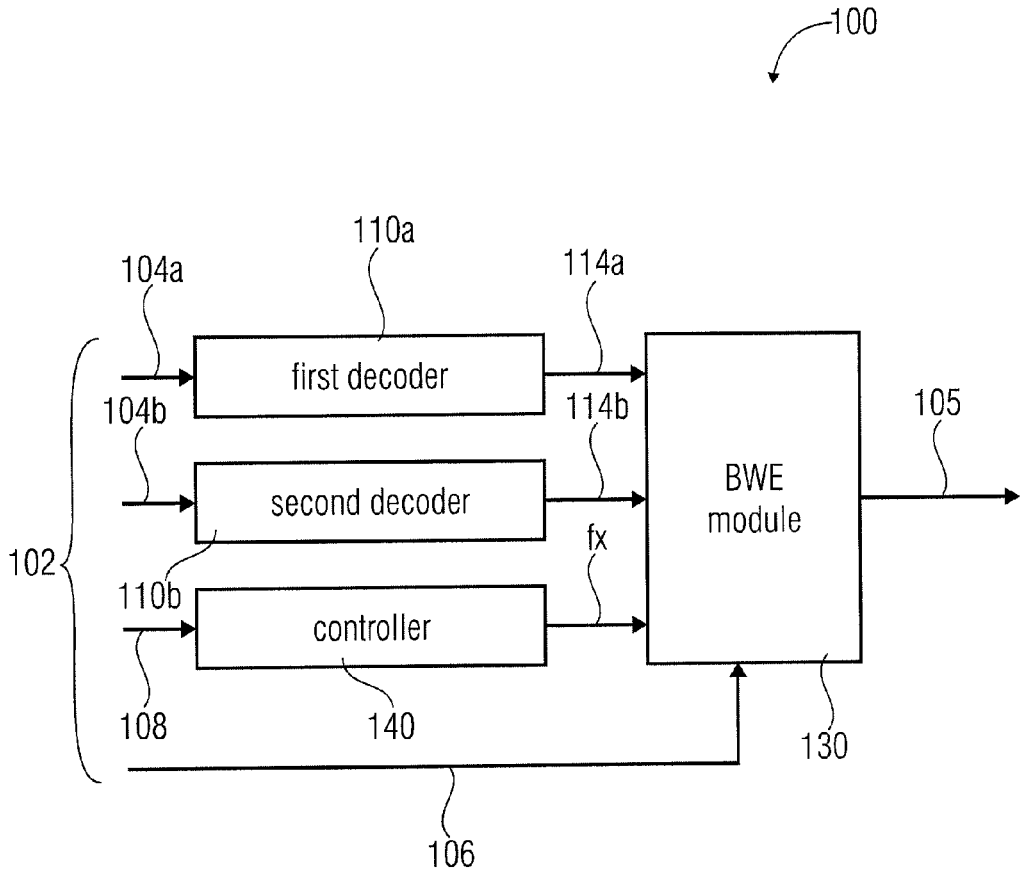
FIG. 1 shows a block diagram of an apparatus for decoding in accordance with a first aspect of the present invention.

FIG. 1 shows a decoder apparatus 100 for decoding an encoded audio signal 102. The encoded audio signal 102 comprising a first portion 104*a* encoded in accordance with the first encoding algorithm, a second portion 104*b* encoded in accordance with a second encoding algorithm, BWE parameter 106 for the first time portion 104*a* and the second time portion 104*b* and a coding mode information 108 indicating a first decoding algorithm or a second decoding algorithm for the respective time portions. The apparatus for decoding 100 comprises a first decoder 110*a*, a second decoder 110*b*, a BWE module 130 and a controller 140. The first decoder 110*a* is adapted to decode the first portion 104*a* in accordance with the first decoding algorithm for a first time portion of the encoded signal 102 to obtain a first decoded signal 114*a*. The second decoder 110*b* is configured to decode the second portion 104*b* in accordance with the second decoding algorithm for a second time portion of the encoded signal to obtain a second decoded signal 114*b*. The BWE module 130 has a controllable crossover frequency fx that adjusts the behavior of the BWE module 130. The BWE module 130 is configured to perform a bandwidth extension algorithm to generate components of the audio signal in the upper frequency band based on the first decoded signal 114*a* and the BWE parameters 106 for the first portion, and to generate components of the audio signal in the upper frequency band based on the second decoded signal 114*b* and the bandwidth extension parameter 106 for the second portion. The controller 140 is configured to control the crossover frequency fx of the BWE module 130 in accordance with the coding mode information 108.

The BWE module 130 may comprise also a combiner combining the audio signal components of lower and the upper frequency band and outputs the resulting audio signal 105.

The coding mode information 108 indicates, for example which time portion of the encoded audio signal 102 is encoded by which encoding algorithm. This information may at the same time identify the decoder to be used for the different time portions. In addition, the coding mode information 108 may control a switch to switch between different decoders for different time portions.

Hence, the crossover frequency fx is an adjustable parameter which is adjusted in accordance with the used decoder which may, for example, comprise a speech coder as the first decoder 110*a* and an audio decoder as the second decoder 110*b*. As said above, the crossover frequency fx for a speech decoder (as for example based on LPC) may be higher than the crossover frequency used for an audio decoder (e.g. for music). Thus, in further embodiments the controller 220 is configured to increase the crossover frequency fx or to decrease the crossover frequency fx within one of the time portion (e.g. the second time portion) so that the crossover frequency may be changed without changing the decoding algorithm. This means that a change in the crossover frequency may not be related to a change in the used decoder: the crossover frequency may be changed without changing the used decoder or vice versa the decoder may be changed without changing the crossover frequency.

The BWE module 130 may also comprise a switch which is controlled by the controller 140 and/or by the BWE parameter 106 so that the first decoded signal 114*a* is processed by the BWE module 130 during the first time portion and the second decoded signal 114*b* is processed by the BWE module 130 during the second time portion. This switch may be activated by a change in the crossover frequency fx or by an explicit bit within the encoded audio signal 102 indicating the used encoding algorithm during the respective time portion.

In further embodiments the switch is configured to switch between the first and second time portion from the first decoder to the second decoder so that the bandwidth extension algorithm is either applied to the first decoded signal or to the second decoded signal. Alternatively, the bandwidth extension algorithm is applied to the first and/or to second decoded signal and the switch is placed after this so that one of the bandwidth extended signals is dropped.

Figure 2:
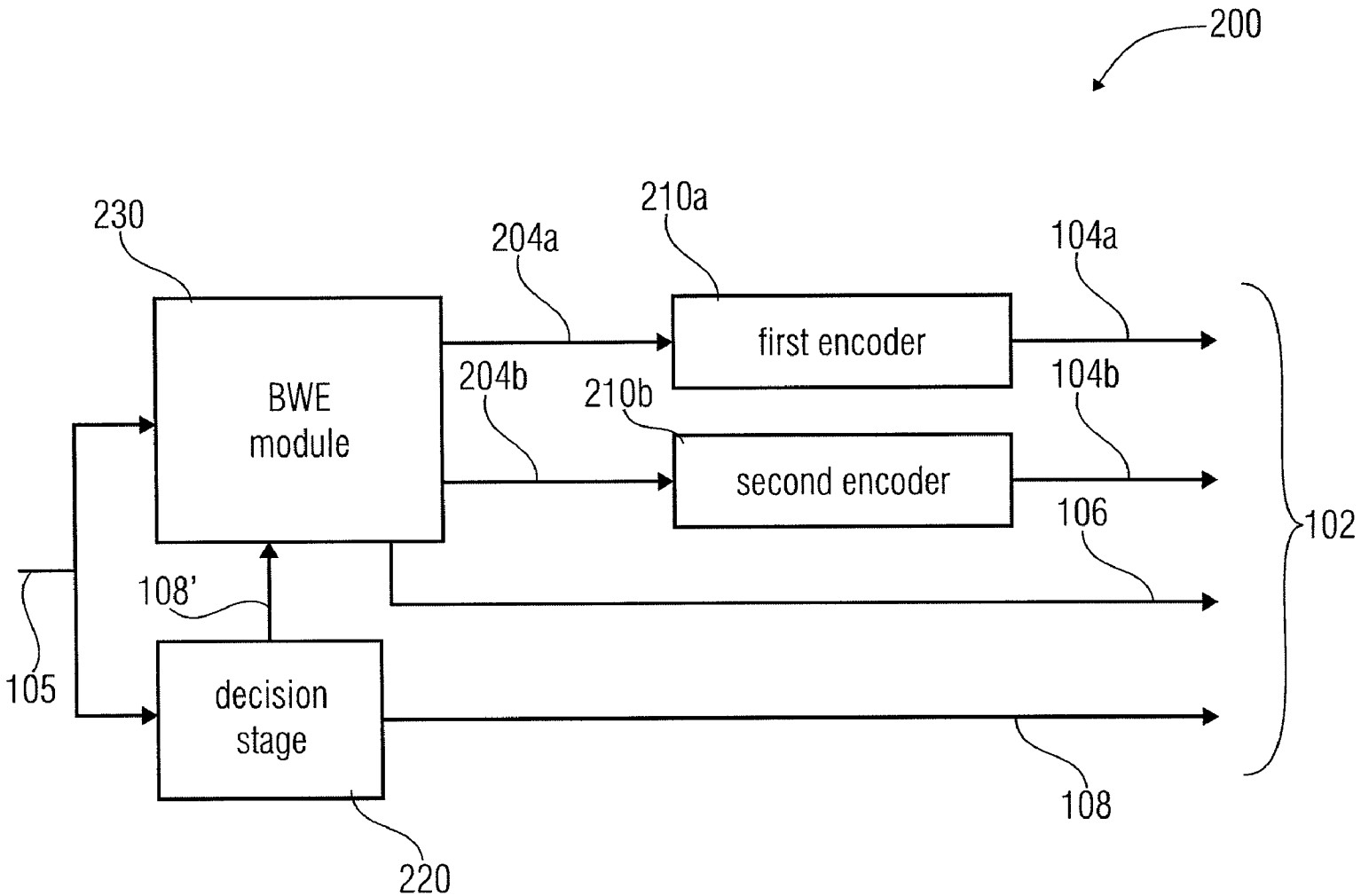
FIG. 2 shows a block diagram of an apparatus for encoding in accordance with the first aspect of the present invention.

FIG. 2 shows a block diagram for an apparatus 200 for encoding an audio signal 105. The apparatus for encoding 200 comprises a first encoder 210*a*, a second encoder 210*b*, a decision stage 220 and a bandwidth extension module (BWE module) 230. The first encoder 210*a* is operative to encode in accordance with a first encoding algorithm having a first frequency bandwidth. The second encoder 210*b* is operative to encode in accordance with a second encoding algorithm having a second frequency bandwidth being smaller than the first frequency bandwidth. The first encoder may, for example, be a speech coder such as an LPC-based coder, whereas the second encoder 210*b* may comprise an audio (music) encoder. The decision stage 220 is configured to indicate the first encoding algorithm for a first portion 204*a* of the audio signal 105 and to indicate the second encoding algorithm for a second portion 204*b* of the audio signal 105, wherein the second time portion being different from the first time portion. The first portion 204*a* may correspond to a first time portion and the second portion 204*b* may correspond to a second time portion which is different from the first time portion.

The BWE module 230 is configured to calculate BWE parameters 106 for the audio signal 105 and is configured to be controlled by the decision stage 220 to calculate the BWE parameter 106 for a first band not including the first frequency bandwidth in the first time portion 204*a* of the audio signal 105. The BWE module 230 is further configured to calculate the BWE parameter 106 for a second band not including the second bandwidth in the second time portion 204*b* of the audio signal 105. The first (second) band comprises hence frequency components of the audio signal 105 which are outside the first (second) frequency bandwidth and are limited towards the lower end of the spectrum by the crossover frequency fx. The first or the second bandwidth can therefore be defined by a variable crossover frequency which is controlled by the decision stage 220.

In addition, the BWE module 230 may comprise a switch controlled by the decision stage 220. The decision stage 220 may determine an advantageous coding algorithm for a given time portion and controls the switch so that during the given time portion the advantageous coder is used. The modified coding mode information 108' comprises the corresponding switch signal. Moreover, the BWE module 230 may also comprise a filter to obtain components of the audio signal 105 in the lower/upper frequency band which are separated by the crossover frequency fx which may comprise a value of about 4 kHz or 5 kHz. Finally the BWE module 130 may also comprise an analyzing tool to determine the BWE parameter 106. The modified coding mode information 108' may be equivalent (or equal) to the coding mode information 108. The coding mode information 108 indicates, for example, the used coding algorithm for the respective time portions in the bitstream of the encoded audio signal 105.

According to further embodiments, the decision stage 220 comprises a signal classifier tool which analyzes the original input signal 105 and generates the control information 108 which triggers the selection of the different coding modes. The analysis of the input signal 105 is implementation dependent with the aim to choose the optimal core coding mode for a given input signal frame. The output of the signal classifier can (optionally) also be used to influence the behavior of other tools, for example, MPEG surround, enhanced SBR, time-warped filterbank and others. The input to the signal classifier tool comprises, for example, the original unmodified input signal 105, but also optionally additional implementation dependent parameters. The output of the signal classifier tool comprises the control signal 108 to control the selection of the core codec (for example non-LP filtered frequency domain or LP filtered time or frequency domain coding or further coding algorithms).

According to embodiments, the crossover frequency fx is adjusted signal dependent which is combined with the switching decision to use a different coding algorithm. Therefore, a simple switch signal may simply be a change (a jump) in the crossover frequency fx. In addition, the coding mode information 108 may also comprise the change of the crossover frequency fx indicating at the same time an advantageous coding scheme (e.g. speech/audio/music).

According to further embodiments the decision stage 220 is operative to analyze the audio signal 105 or a first output of the first encoder 210*a* or a second output of the second encoder 210*b* or a signal obtained by decoding an output signal of the encoder 210*a* or the second encoder 210*b* with respect to a target function. The decision stage 220 may optionally be operative to perform a speech/music discrimination in such a way that a decision to speech is favored with respect to a decision to music so that a decision to speech is taken, e.g., even when a portion less than 50% of a frame for the first switch is speech and a portion more than 50% of the frame for the first switch is music. Therefore, the decision stage 220 may comprise an analysis tool that analyses the audio signal to decide whether the audio signal is mainly a speech signal or mainly a music signal so that based on the result the decision stage can decide which is the best codec to be used for the analysed time portion of the audio signal.

FIGS. 1 and 2 do not show many of these details for the encoder/decoder. Possible detailed examples for the encoder/ decoder are shown in the following figures. In addition to the first and second decoder 110*a,b* of FIG. 1 further decoders may be present which may or may not use e.g. further encoding algorithms. In the same way, also the encoder 200 of FIG. 2 may comprise additional encoders which may use additional encoding algorithms. In the following the example with two encoders/decoders will be explained in more detail.

Figure 3:
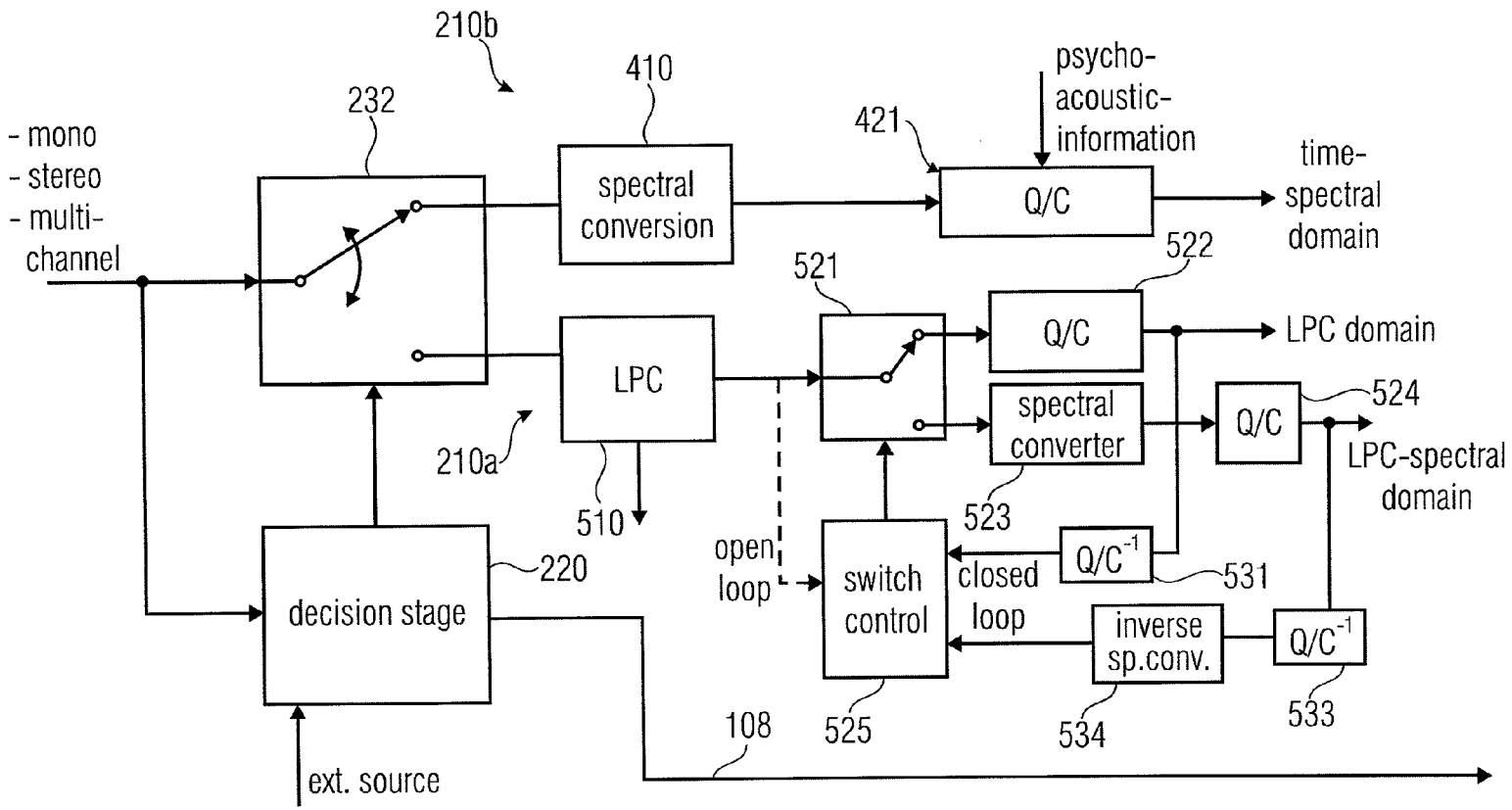
FIG. 3 shows a block diagram of an encoding scheme in more details.

FIG. 3 illustrates in more details an encoder having two cascaded switches. A mono signal, a stereo signal or a multi-channel signal is input into a decision stage 220 and into a switch 232 which is part of the BWE module 230 of FIG. 2. The switch 232 is controlled by the decision stage 220. Alternatively, the decision stage 220 may also receive a side information which is included in the mono signal, the stereo signal or the multi-channel signal or is at least associated to such a signal, where information is existing, which was, for example, generated when originally producing the mono signal, the stereo signal or the multi-channel signal.

The decision stage 220 actuates the switch 232 in order to feed a signal either in a frequency encoding portion 210*b* illustrated now at an upper branch of FIG. 3 or an LPC-domain encoding portion 210*a* illustrated at a lower branch in FIG. 3. A key element of the frequency domain encoding branch is a spectral conversion block 410 which is operative to convert a common preprocessing stage output signal (as discussed later on) into a spectral domain. The spectral conversion block may include an MDCT algorithm, a QMF, an FFT algorithm, a Wavelet analysis or a filterbank such as a critically sampled filterbank having a certain number of filterbank channels, where the subband signals in this filterbank may be real valued signals or complex valued signals. The output of the spectral conversion block 410 is encoded using a spectral audio encoder 421 which may include processing blocks as known from the AAC coding scheme.

Generally, the processing in branch 210*b* is a processing based on a perception based model or information sink model. Thus, this branch models the human auditory system receiving sound. Contrary thereto, the processing in branch 210*a* is to generate a signal in the excitation, residual or LPC domain. Generally, the processing in branch 210*a* is a processing based on a speech model or an information generation model. For speech signals, this model is a model of the human speech/sound generation system generating sound. If, however, a sound from a different source requiring a different sound generation model is to be encoded, then the processing in branch 210*a* may be different. In addition to the shown coding branches, further embodiments comprise additional branches or core coders. For example, different coders may optionally be present for the different sources, so that sound from each source may be coded by employing an advantageous coder.

In the lower encoding branch 210*a*, a key element is an LPC device 510 which outputs LPC information which is used for controlling the characteristics of an LPC filter. This LPC information is transmitted to a decoder. The LPC stage 510 output signal is an LPC-domain signal which consists of an excitation signal and/or a weighted signal.

The LPC device generally outputs an LPC domain signal which can be any signal in the LPC domain or any other signal which has been generated by applying LPC filter coefficients to an audio signal. Furthermore, an LPC device can also determine these coefficients and can also quantize/encode these coefficients.

The decision in the decision stage 220 can be signal-adaptive so that the decision stage performs a music/speech discrimination and controls the switch 232 in such a way that music signals are input into the upper branch 210*b*, and speech signals are input into the lower branch 210*a*. In one embodiment, the decision stage 220 is feeding its decision information into an output bit stream so that a decoder can use this decision information in order to perform the correct decoding operations. This decision information may, for example, comprise the coding mode information 108 which may also comprise information about the crossover frequency fx or a change of the crossover frequency fx.

Figure 4:
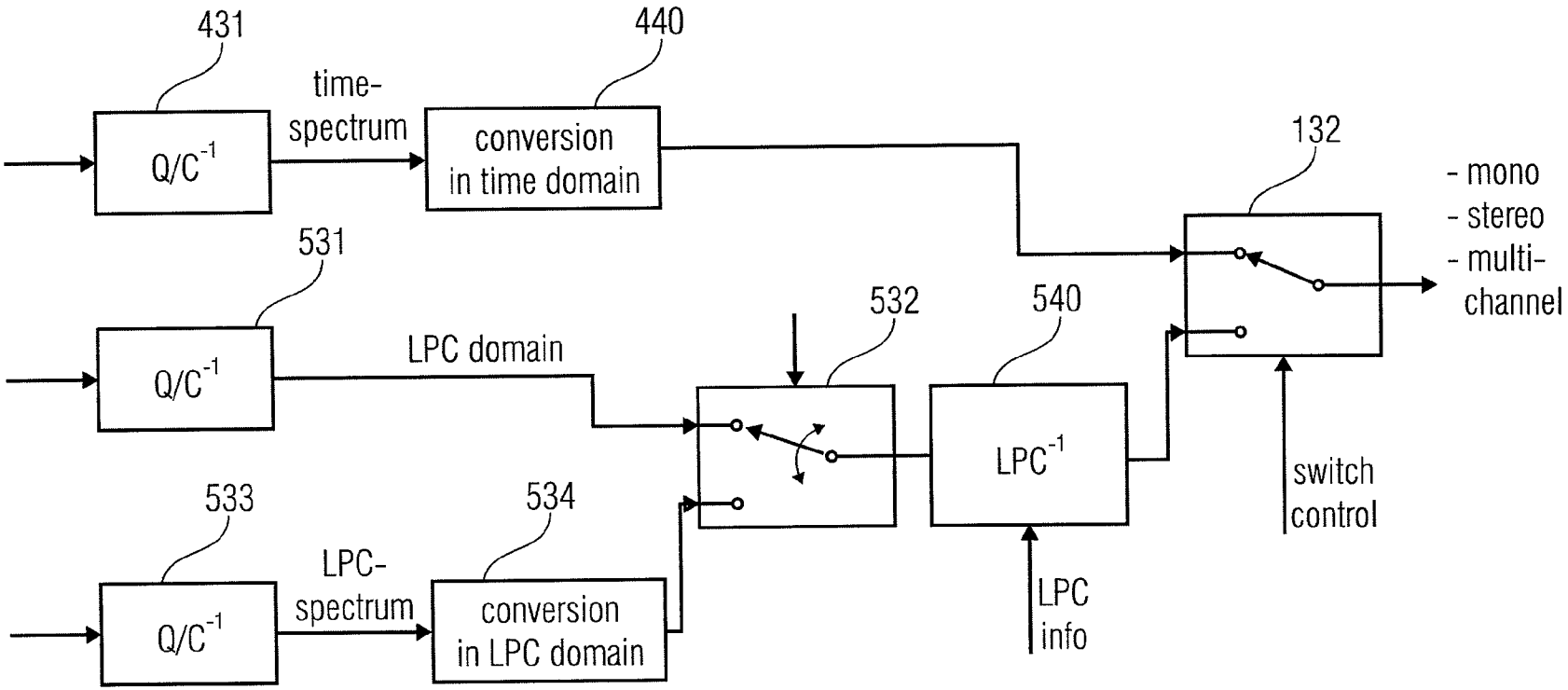
FIG. 4 shows a block diagram of a decoding scheme in more details.

Such a decoder is illustrated in FIG. 4. The signal output of the spectral audio encoder 421 is, after transmission, input into a spectral audio decoder 431. The output of the spectral audio decoder 431 is input into a time-domain converter 440 (the time-domain converter may in general be a converter from a first to a second domain). Analogously, the output of the LPC domain encoding branch 210*a* of FIG. 3 received on the decoder side and processed by elements 531, 533, 534, and 532 for obtaining an LPC excitation signal. The LPC excitation signal is input into an LPC synthesis stage 540 which receives, as a further input, the LPC information generated by the corresponding LPC analysis stage 510. The output of the time-domain converter 440 and/or the output of the LPC synthesis stage 540 are input into a switch 132 which may be part of the BWE module 130 in FIG. 1. The switch 132 is controlled via a switch control signal (such as the coding mode information 108 and/or the BWE parameter 106) which was, for example, generated by the decision stage 220, or which was externally provided such as by a creator of the original mono signal, stereo signal or multi-channel signal.

In FIG. 3, the input signal into the switch 232 and the decision stage 220 can be a mono signal, a stereo signal, a multi-channel signal or generally any audio signal. Depending on the decision which can be derived from the switch 232 input signal or from any external source such as a producer of the original audio signal underlying the signal input into stage 232, the switch switches between the frequency encoding branch 210*b* and the LPC encoding branch 210*a*. The frequency encoding branch 210*b* comprises a spectral conversion stage 410 and a subsequently connected quantizing/coding stage 421. The quantizing/coding stage can include any of the functionalities as known from modern frequency-domain encoders such as the AAC encoder. Furthermore, the quantization operation in the quantizing/coding stage 421 can be controlled via a psychoacoustic module which generates psychoacoustic information such as a psychoacoustic masking threshold over the frequency, where this information is input into the stage 421.

In the LPC encoding branch 210*a*, the switch output signal is processed via an LPC analysis stage 510 generating LPC side info and an LPC-domain signal. The excitation encoder may comprise an additional switch for switching the further processing of the LPC-domain signal between a quantization/coding operation 522 in the LPC-domain or a quantization/coding stage 524 which is processing values in the LPC-spectral domain. To this end, a spectral converter 523 is provided at the input of the quantizing/coding stage 524. The switch 521 is controlled in an open loop fashion or a closed loop fashion depending on specific settings as, for example, described in the AMR-WB+ technical specification.

For the closed loop control mode, the encoder additionally includes an inverse quantizer/coder 531 for the LPC domain signal, an inverse quantizer/coder 533 for the LPC spectral domain signal and an inverse spectral converter 534 for the output of item 533. Both encoded and again decoded signals in the processing branches of the second encoding branch are input into the switch control device 525. In the switch control device 525, these two output signals are compared to each other and/or to a target function or a target function is calculated which may be based on a comparison of the distortion in both signals so that the signal having the lower distortion is used for deciding, which position the switch 521 should take. Alternatively, in case both branches provide non-constant bit rates, the branch providing the lower bit rate might be selected even when the distortion or the perceptional distortion of this branch is lower than the distortion or perceptional distortion of the other branch (an example for the distortion may be the signal to noise ratio). Alternatively, the target function could use, as an input, the distortion of each signal and a bit rate of each signal and/or additional criteria in order to find the best decision for a specific goal. If, for example, the goal is such that the bit rate should be as low as possible, then the target function would heavily rely on the bit rate of the two signals output of the elements 531, 534. However, when the main goal is to have the best quality for a certain bit rate, then the switch control 525 might, for example, discard each signal which is above the allowed bit rate and when both signals are below the allowed bit rate, the switch control would select the signal having the better estimated subjective quality, i.e., having the smaller quantization/coding distortions or a better signal to noise ratio.

The decoding scheme in accordance with an embodiment is, as stated before, illustrated in FIG. 4. For each of the three possible output signal kinds, a specific decoding/re-quantizing stage 431, 531 or 533 exists. While stage 431 outputs a frequency-spectrum which is converted into the time-domain using the frequency/time converter 440, stage 531 outputs an LPC-domain signal, and item 533 outputs an LPC-spectrum. In order to make sure that the input signals into switch 532 are both in the LPC-domain, the LPC-spectrum/LPC-converter 534 is provided. The output data of the switch 532 is transformed back into the time-domain using an LPC synthesis stage 540 which is controlled via encoder-side generated and transmitted LPC information. Then, subsequent to block 540, both branches have time-domain information which is switched in accordance with a switch control signal in order to finally obtain an audio signal such as a mono signal, a stereo signal or a multi-channel signal which depends on the signal input into the encoding scheme of FIG. 3.

Figure 5:
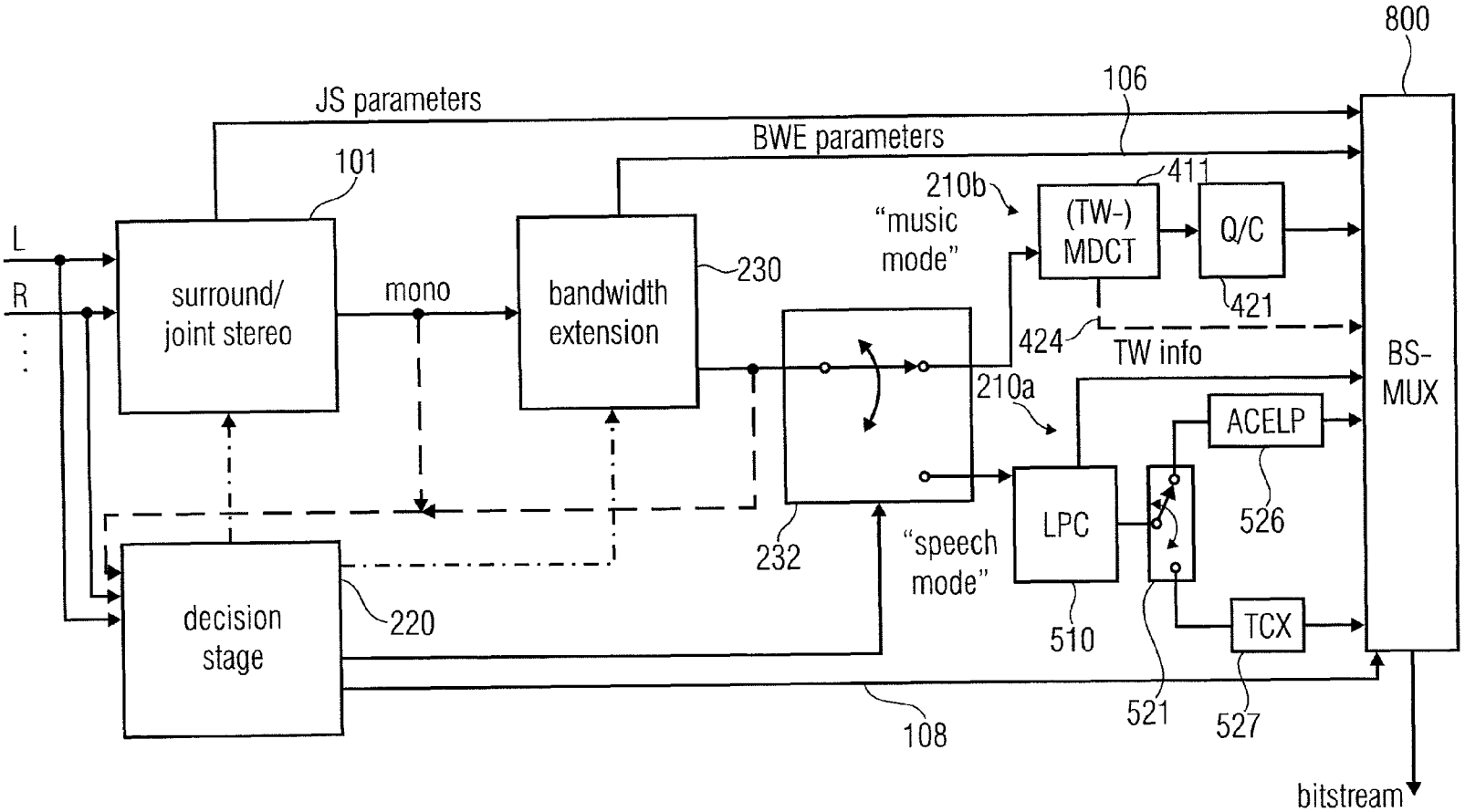
FIG. 5 shows a block diagram of an encoding scheme in accordance with a second aspect.
Figure 6:
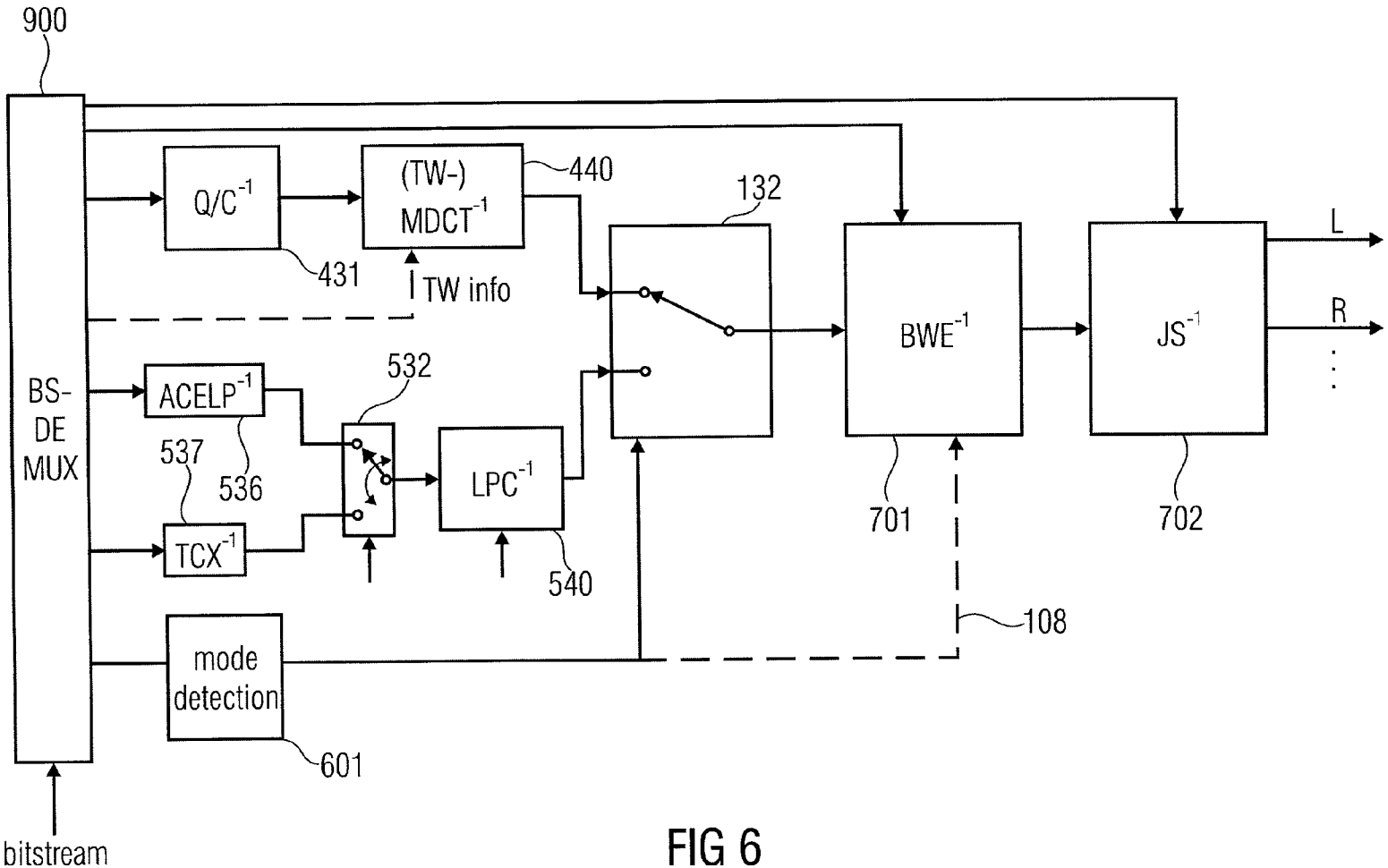
FIG. 6 is a schematic diagram of a decoding scheme in accordance with the second aspect.

FIGS. 5 and 6 show further embodiments for the encoder/decoder, wherein the BWE stages as part of the BWE modules 130, 230 represent a common processing unit.

FIG. 5 illustrates an encoding scheme, wherein the common preprocessing scheme connected to the switch 232 input may comprise a surround/joint stereo block 101 which generates, as an output, joint stereo parameters and a mono output signal which is generated by downmixing the input signal which is a signal having two or more channels. Generally, the signal at the output of block 101 can also be a signal having more channels, but due to the downmixing functionality of block 101, the number of channels at the output of block 101 will be smaller than the number of channels input into block 101.

The common preprocessing scheme may comprise in addition to the block 101*a* bandwidth extension stage 230. In the FIG. 5 embodiment, the output of block 101 is input into the bandwidth extension block 230 which outputs a band-limited signal such as the low band signal or the low pass signal at its output. Advantageously, this signal is downsampled (e.g. by a factor of two) as well. Furthermore, for the high band of the signal input into block 230, bandwidth extension parameters 106 such as spectral envelope parameters, inverse filtering parameters, noise floor parameters etc. as known from HE-AAC profile of MPEG-4 are generated and forwarded to a bitstream multiplexer 800.

Advantageously, the decision stage 220 receives the signal input into block 101 or input into block 230 in order to decide between, for example, a music mode or a speech mode. In the music mode, the upper encoding branch 210*b* (second encoder in FIG. 2) is selected, while, in the speech mode, the lower encoding branch 210*a* is selected. Advantageously, the decision stage additionally controls the joint stereo block 101 and/or the bandwidth extension block 230 to adapt the functionality of these blocks to the specific signal. Thus, when the decision stage 220 determines that a certain time portion of the input signal corresponds to the first mode such as the music mode, then specific features of block 101 and/or block 230 can be controlled by the decision stage 220. Alternatively, when the decision stage 220 determines that the signal corresponds to a speech mode or, generally, in a second LPC-domain mode, then specific features of blocks 101 and 230 can be controlled in accordance with the decision stage output. The decision stage 220 yields also the control information 108 and/or the crossover frequency fx which may also be transmitted to the BWE block 230 and, in addition, to a bitstream multiplexer 800 so that it will be transmitted to the decoder side.

Advantageously, the spectral conversion of the coding branch 210*b* is done using an MDCT operation which, even more advantageously, is the time-warped MDCT operation, where the strength or, generally, the warping strength can be controlled between zero and a high warping strength. In a zero warping strength, the MDCT operation in block 411 is a straight-forward MDCT operation known in the art. The time warping strength together with time warping side information can be transmitted/input into the bitstream multiplexer 800 as side information.

In the LPC encoding branch, the LPC-domain encoder may include an ACELP core 526 calculating a pitch gain, a pitch lag and/or codebook information such as a codebook index and gain. The TCX mode as known from 3GPP TS 26.290 includes a processing of a perceptually weighted signal in the transform domain. A Fourier transformed weighted signal is quantized using a split multi-rate lattice quantization (algebraic VQ) with noise factor quantization. A transform is calculated in 1024, 512, or 256 sample windows. The excitation signal is recovered by inverse filtering the quantized weighted signal through an inverse weighting filter. The TCX mode may also be used in modified form in which the MDCT is used with an enlarged overlap, scalar quantization, and an arithmetic coder for encoding spectral lines.

In the "music" coding branch 210*b*, a spectral converter advantageously comprises a specifically adapted MDCT operation having certain window functions followed by a quantization/entropy encoding stage which may consist of a single vector quantization stage, but advantageously is a combined scalar quantizer/entropy coder similar to the quantizer/coder in the frequency domain coding branch, i.e., in item 421 of FIG. 5.

In the "speech" coding branch 210*a*, there is the LPC block 510 followed by a switch 521, again followed by an ACELP block 526 or a TCX block 527. ACELP is described in 3GPP TS 26.190 and TCX is described in 3GPP TS 26.290. Generally, the ACELP block 526 receives an LPC excitation signal as calculated by a procedure as described in FIG. 7. The TCX block 527 receives a weighted signal as generated by FIG. 8.

At the decoder side illustrated in FIG. 6, after the inverse spectral transform in block 537, the inverse of the weighting filter is applied that is $(1-\mu z^{-1})/(1-A(z/\gamma))$. Then, the signal is filtered through $(1-A(z))$ to go to the LPC excitation domain.

Thus, the conversion to LPC domain block 534 and the $TCX^{-1}$ block 537 include inverse transform and then filtering through $$\frac{(1-\mu z^{-1})}{(1-A(z/\gamma))}(1-A(z))$$

to convert from the weighted domain to the excitation domain.

Although item 510 in FIGS. 3, 5 illustrates a single block, block 510 can output different signals as long as these signals are in the LPC domain. The actual mode of block 510 such as the excitation signal mode or the weighted signal mode can depend on the actual switch state. Alternatively, the block 510 can have two parallel processing devices, where one device is implemented similar to FIG. 7 and the other device is implemented as FIG. 8. Hence, the LPC domain at the output of 510 can represent either the LPC excitation signal or the LPC weighted signal or any other LPC domain signal.

In the second encoding branch (ACELP/TCX) of FIG. 5, the signal is advantageously pre-emphasized through a filter $1-\mu z^{-1}$ before encoding. At the ACELP/TCX decoder in FIG. 6 the synthesized signal is deemphasized with the filter $1/(1-\mu z^{-})$. In an advantageous embodiment, the parameter $\mu$ has the value 0.68. The preemphasis can be part of the LPC block 510 where the signal is preemphasized before LPC analysis and quantization. Similarly, deemphasis can be part of the LPC synthesis block $LPC^{-1}$ 540.

FIG. 6 illustrates a decoding scheme corresponding to the encoding scheme of FIG. 5. The bitstream generated by bitstream multiplexer 800 (or output interface) of FIG. 5 is input into a bitstream demultiplexer 900 (or input interface). Depending on an information derived for example from the bitstream via a mode detection block 601 (e.g. part of the controller 140 in FIG. 1), a decoder-side switch 132 is controlled to either forward signals from the upper branch or signals from the lower branch to the bandwidth extension block 701. The bandwidth extension block 701 receives, from the bitstream demultiplexer 900, side information and, based on this side information and the output of the mode detection 601, reconstructs the high band based on the low band output by switch 132. The control signal 108 controls the used cross-over frequency fx.

The full band signal generated by block 701 is input into the joint stereo/surround processing stage 702 which reconstructs two stereo channels or several multi-channels. Generally, block 702 will output more channels than were input into this block. Depending on the application, the input into block 702 may even include two channels such as in a stereo mode and may even include more channels as long as the output of this block has more channels than the input into this block.

The switch 232 in FIG. 5 has been shown to switch between both branches so that only one branch receives a signal to process and the other branch does not receive a signal to process. In an alternative embodiment, however, the switch 232 may also be arranged subsequent to for example the audio encoder 421 and the excitation encoder 522, 523, 524, which means that both branches 210*a*, 210*b* process the same signal in parallel. In order to not double the bitrate, however, only the signal output of one of those encoding branches 210*a* or 210*b* is selected to be written into the output bitstream. The decision stage will then operate so that the signal written into the bitstream minimizes a certain cost function, where the cost function can be the generated bitrate or the generated perceptual distortion or a combined rate/distortion cost function. Therefore, either in this mode or in the mode illustrated in the Figures, the decision stage can also operate in a closed loop mode in order to make sure that, finally, only the encoding branch output is written into the bitstream which has for a given perceptual distortion the lowest bitrate or, for a given bitrate, has the lowest perceptual distortion. In the closed loop mode, the feedback input may be derived from outputs of the three quantizer/scaler blocks 421, 522 and 424 in FIG. 3.

Also in the embodiment of FIG. 6, the switch 132 may in alternative embodiments be arranged after the BWE module 701 so that the bandwidth extension is performed in parallel for both branches and the switch selects one of the two bandwidth extended signals.

In the implementation having two switches, i.e., the first switch 232 and the second switch 521, it is advantageous that the time resolution for the first switch is lower than the time resolution for the second switch. Stated differently, the blocks of the input signal into the first switch which can be switched via a switch operation are larger than the blocks switched by the second switch 521 operating in the LPC-domain. Exemplarily, the frequency domain/LPC-domain switch 232 may switch blocks of a length of 1024 samples, and the second switch 521 can switch blocks having 256 samples each.

Figure 7:
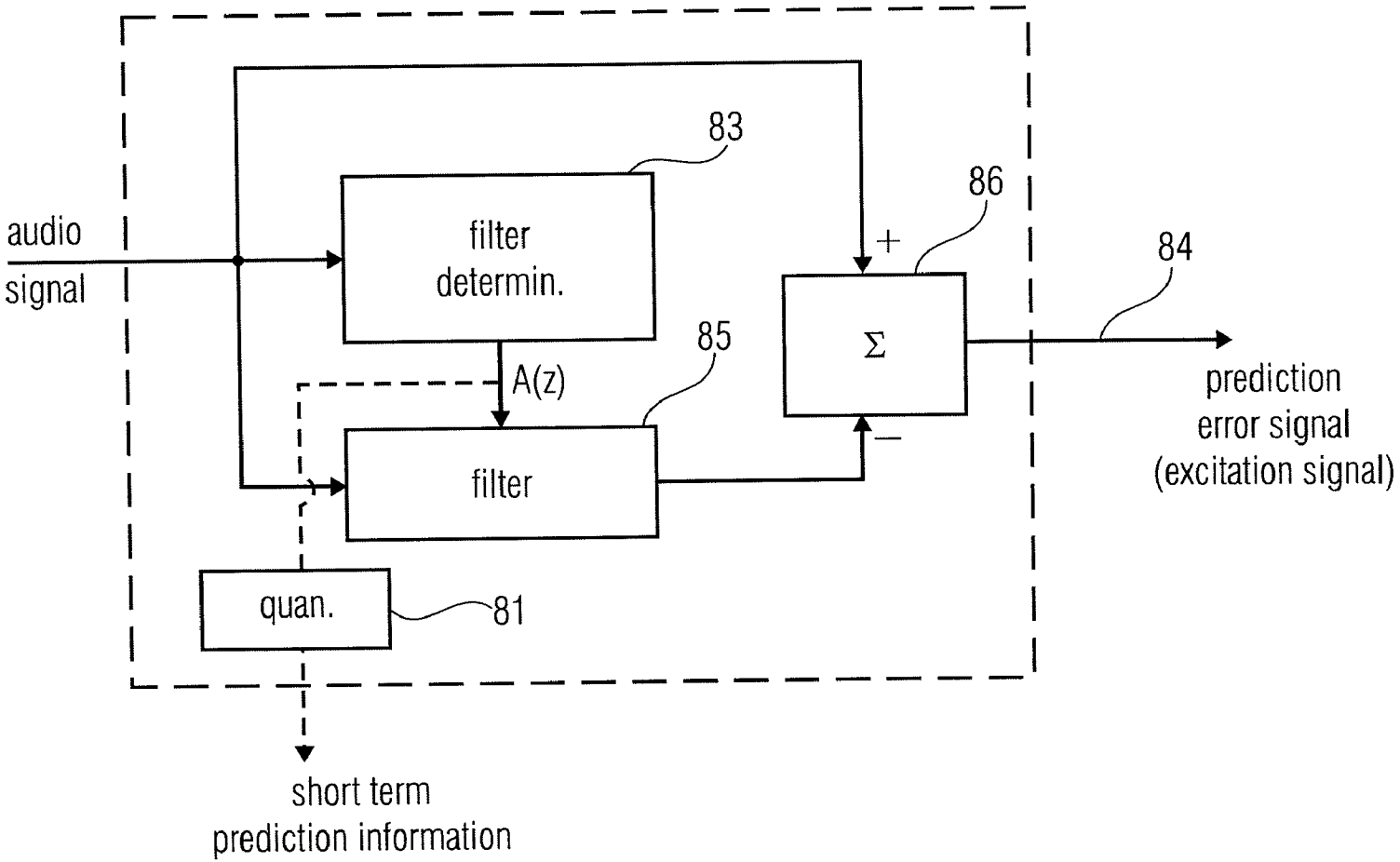
FIG. 7 illustrates an encoder-side LPC stage providing short-term prediction information and the prediction error signal.

FIG. 7 illustrates a more detailed implementation of the LPC analysis block 510. The audio signal is input into a filter determination block 83 which determines the filter information A(z). This information is output as the short-term prediction information that may be used for a decoder. The short-term prediction information that may be used by the actual prediction filter 85. In a subtracter 86, a current sample of the audio signal is input and a predicted value for the current sample is subtracted so that for this sample, the prediction error signal is generated at line 84.

Figure 8:
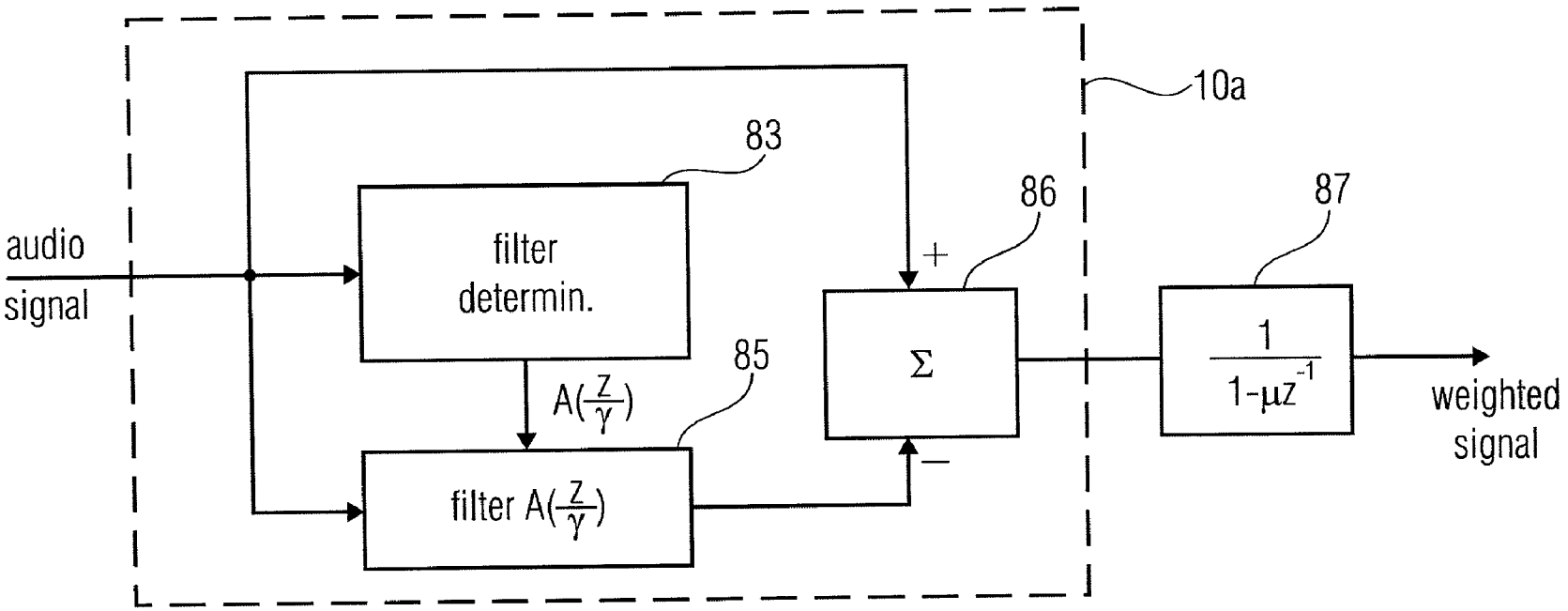
FIG. 8 illustrates a further embodiment of an LPC device for generating a weighted signal.

While FIG. 7 illustrates an advantageous way to calculate the excitation signal, FIG. 8 illustrates an advantageous way to calculate the weighted signal. In contrast to FIG. 7, the filter 85 is different, when $\gamma$ is different from 1. A value smaller than 1 is advantageous for $\gamma$. Furthermore, the block 87 is present, and $\mu$ is advantageous a number smaller than 1. Generally, the elements in FIGS. 7 and 8 can be implemented as in 3GPP TS 26.190 or 3GPP TS 26.290.

Subsequently, an analysis-by-synthesis CELP encoder is discussed in order to illustrate the modifications applied to this algorithm. This CELP encoder is discussed in detail in "Speech Coding: A Tutorial Review", Andreas Spanias, Proceedings of the IEEE, Vol. 82, No. 10, October 1994, pages 1541-1582.

For specific cases, when a frame is a mixture of unvoiced and voiced speech or when speech over music occurs, a TCX coding can be more appropriate to code the excitation in the LPC domain. The TCX coding processes directly the excitation in the frequency domain without doing any assumption of excitation production. The TCX is then more generic than CELP coding and is not restricted to a voiced or a non-voiced source model of the excitation. TCX is still a source-filter model coding using a linear predictive filter for modelling the formants of the speech-like signals.

In the AMR-WB+-like coding, a selection between different TCX modes and ACELP takes place as known from the AMR-WB+ description. The TCX modes are different in that the length of the block-wise Fast Fourier Transform is different for different modes and the best mode can be selected by an analysis by synthesis approach or by a direct "feedforward" mode.

As discussed in connection with FIGS. 5 and 6, the common pre-processing stage 100 advantageously includes a joint multi-channel (surround/joint stereo device) 101 and, additionally, a bandwidth extension stage 230. Correspondingly, the decoder includes a bandwidth extension stage 701 and a subsequently connected joint multichannel stage 702. Advantageously, the joint multichannel stage 101 is, with respect to the encoder, connected before the band width extension stage 230, and, on the decoder side, the band width extension stage 701 is connected before the joint multichannel stage 702 with respect to the signal processing direction. Alternatively, however, the common pre-processing stage can include a joint multichannel stage without the subsequently connected bandwidth extension stage or a bandwidth extension stage without a connected joint multichannel stage.

Figure 9A:
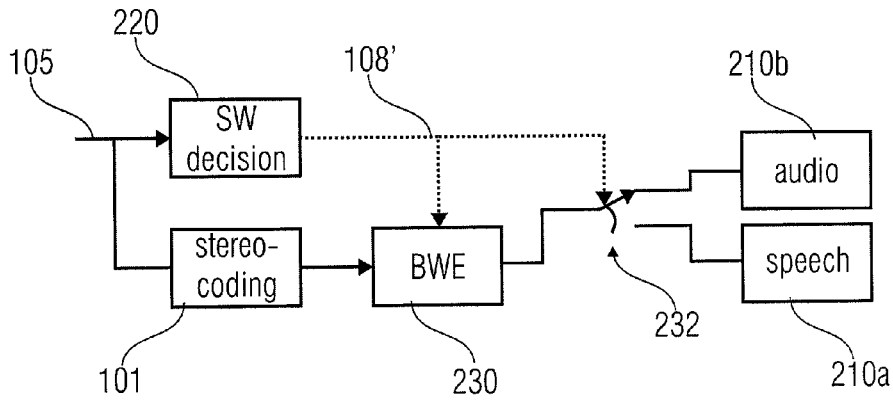
FIGS. 9*a*-9*b* show an encoder comprising an audio/speech-switch resulting in different temporal resolution for an audio signal.
Figure 9B:
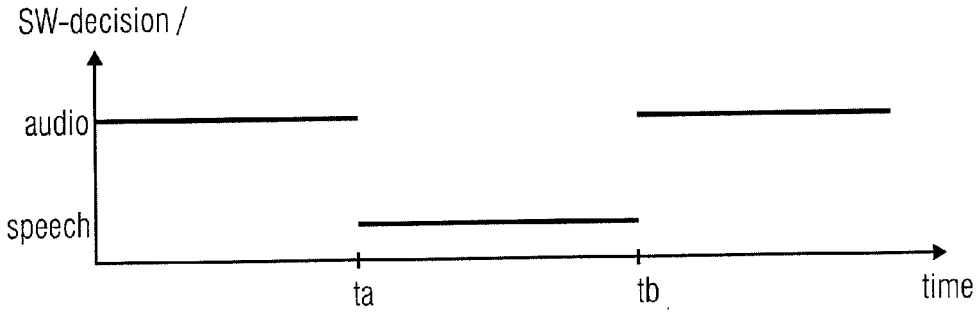

FIGS. 9*a* to 9*b* show a simplified view on the encoder of FIG. 5, where the encoder comprises the switch-decision unit 220 and the stereo coding unit 101. In addition, the encoder also comprises the bandwidth extension tools 230 as, for example, an envelope data calculator and SBR-related modules. The switch-decision unit 220 provides a switch decision signal 108' that switches between the audio coder 210*b* and the speech coder 210*a*. The speech coder 210*a* may further be divided into a voiced and unvoiced coder. Each of these coders may encode the audio signal in the core frequency band using different numbers of sample values (e.g. 1024 for a higher resolution or 256 for a lower resolution). The switch decision signal 108' is also supplied to the bandwidth extension (BWE) tool 230. The BWE tool 230 will then use the switch decision 108' in order, for example, to adjust the number of the spectral envelopes 104 and to turn on/off an optional transient detector and adjust the crossover frequency fx. The audio signal 105 is input into the switch-decision unit 220 and is input into the stereo coding 101 so that the stereo coding 101 may produce the sample values which are input into the bandwidth extension unit 230. Depending on the decision 108' generated by the switch-unit decision unit 220, the bandwidth extension tool 230 will generate spectral band replication data which are, in turn, forwarded either to an audio coder 210*b* or a speech coder 210*a*.

The switch decision signal 108' is signal dependent and can be obtained from the switch-decision unit 220 by analyzing the audio signal, e.g., by using a transient detector or other detectors which may or may not comprise a variable threshold. Alternatively, the switch decision signal 108' may be adjusted manually (e.g. by a user) or be obtained from a data stream (included in the audio signal).

The output of the audio coder 210*b* and the speech coder 210*a* may again be input into the bitstream formatter 800 (see FIG. 5).

FIG. 9*b* shows an example for the switch decision signal 108' which detects an audio signal for a time period before a first time ta and after a second time tb. Between the first time ta and the second time tb, the switch-decision unit 220 detects a speech signal resulting in different discrete values for the switch decision signal 108'.

The decision to use a higher crossover frequency fx is controlled by the switching decision unit 220. This means that the described method is also usable within a system in which the SBR module is combined with only a single core coder and a variable crossover frequency fx.

Although some of the FIGS. 1 through 9 are illustrated as block diagrams of an apparatus, these figures simultaneously are an illustration of a method, where the block functionalities correspond to the method steps.

Figure 10:
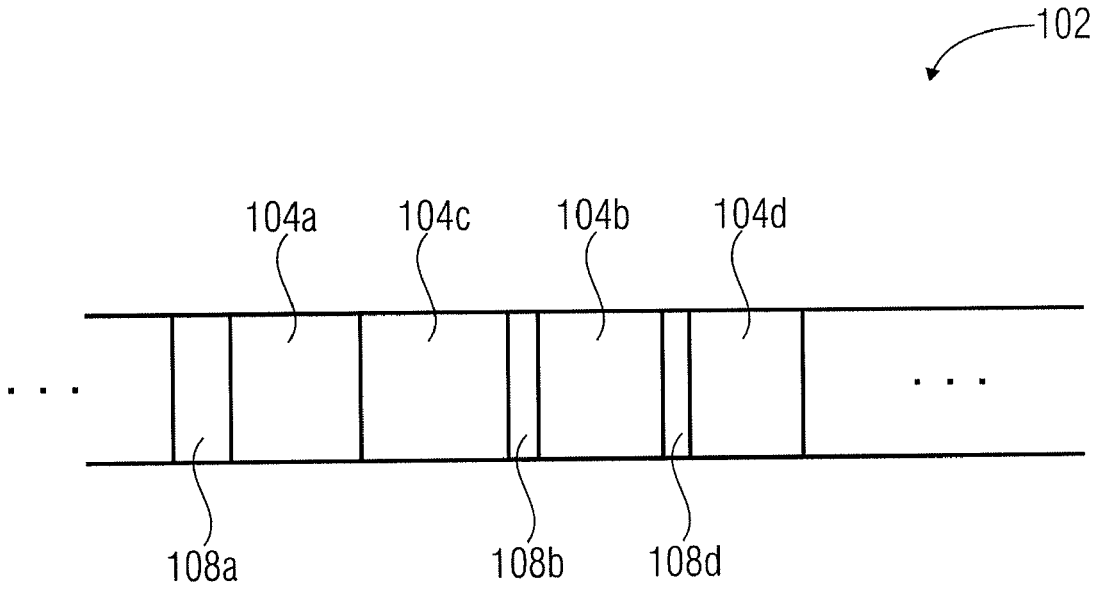
FIG. 10 illustrates a representation for an encoded audio signal.

FIG. 10 illustrates a representation for an encoded audio signal 102 comprising the first portion 104*a*, the second portion 104*b*, a third portion 104*c* and a fourth portion 104*d*. In this representation the encoded audio signal 102 is a bitstream transmitted over a transmission channel which comprises furthermore the coding mode information 108. Each portion 104 of the encoded audio signal 102 may represent a different time portion, although different portions 104 may be in the frequency as well as time domain so that the encoded audio signal 102 may not represent a time line.

In this embodiment the encoded audio signal 102 comprises in addition a first coding mode information 108*a* identifying the used coding algorithm for the first portion 104*a*; a second coding mode information 108*b* identifying the used coding algorithm for the second portion 104*b*; a third coding mode information 108*d* identifying the used coding algorithm for the fourth portion 104*d*. The first coding mode information 108*a* may also identify the used first crossover frequency fx1 within the first portion 104*a*, and the second coding mode information 108*b* may also identify the used second crossover frequency fx2 within the second portion 104*b*. For example, within the first portion 104*a* the "speech" coding mode may be used and within the second portion 104*b* the "music" coding mode may be used so that the first crossover frequency fx1 may be higher than the second crossover frequency fx2.

In this exemplary embodiment the encoded audio signal 102 comprises no coding mode information for the third portion 104*c* which indicates that there is no change in the used encoder and/or crossover frequency fx between the first and third portion 104*a, c*. Therefore, the coding mode information 108 may appear as header only for those portions 104 which use a different core coder and/or crossover frequency compared to the preceding portion. In further embodiments instead of signaling the values of the crossover frequencies for the different portions 104, the code mode information 108 may comprise a single bit indicating the core coder (first or second encoder 210*a,b*) used for the respective portion 104.

Therefore, the signaling of the switch behavior between the different SBR-tools can be done by submitting, for example, as specific bit within the bitstream, so that this specific bit may turn on or off a specific behavior in the decoder. Alternatively, in systems with two core coders according to embodiments the signaling of the switch may also be initiated by analyzing the core codec. In this case the submission of the adaptation of the SBR tools is done implicitly, that means it is determined by the corresponding core coder activity.

More details about the standard description of the bitstream elements for the SBR payload can be found in ISO/IEC 14496-3, sub-clause 4.5.2.8. A modification of this standard bitstream comprises an extension of the index to the master frequency table (to identify the used crossover frequency). The used index is coded, for example, with four bits allowing the crossover band to be variable over a range of 0 to 15 bands.

Embodiments of the present invention can hence be summarized as follows. Different signals with different time/frequency characteristics have different demands on the characteristic on the bandwidth extension. Transient signals (e.g. within a speech signal) need a fine temporal resolution of the BWE and the crossover frequency fx (the upper frequency border of the core coder) should be as high as possible (e.g. 4 kHz or 5 kHz or 6 kHz). Especially in voiced speech, a distorted temporal structure can decrease perceived quality. Tonal signals need a stable reproduction of spectral components and a matching harmonic pattern of the reproduced high frequency portions. The stable reproduction of tonal parts limits the core coder bandwidth but it does not need a BWE with fine temporal but finer spectral resolution. In a switched speech-/audio core coder design, it is possible to use the core coder decision also to adapt both the temporal and spectral characteristics of the BWE as well as adapting the BWE start frequency (crossover frequency) to the signal characteristics. Therefore, embodiments provide a bandwidth extension where the core coder decision acts as adaptation criterion to bandwidth extension characteristics.

The signaling of the changed BWE start (crossover) frequency can be realized explicitly by sending additional information (as, for example, the coding mode information 108) in the bitstream or implicitly by deriving the crossover frequency fx directly from the core coder used (in case the core coder is, e.g., signaled within the bitstream). For example, a lower BWE frequency fx for the transform coder (for example audio/music coder) and a higher for a time domain (speech) coder. In this case, the crossover frequency may be in the range between 0 Hz up to the Nyquist frequency.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. An apparatus for decoding an encoded audio signal, the encoded audio signal comprising a first portion encoded in accordance with a first encoding algorithm, a second portion encoded in accordance with a second encoding algorithm, BWE parameters for the first portion and the second portion and a coding mode information indicating a first decoding algorithm or a second decoding algorithm, comprising:

a first decoder for decoding the first portion in accordance with the first decoding algorithm for a first time portion of the encoded signal to acquire a first decoded signal, wherein the first decoder comprises an LPC-based coder;

a second decoder for decoding the second portion in accordance with the second decoding algorithm for a second time portion of the encoded signal to acquire a second decoded signal, wherein the second decoder comprises a transform-based coder;

a BWE module comprising a controllable crossover frequency, the BWE module being configured for performing a bandwidth extension algorithm using the first decoded signal and the BWE parameters for the first portion, and for performing a bandwidth extension algorithm using the second decoded signal and the bandwidth extension parameter for the second portion, wherein the BWE module is configured to use a first crossover frequency for the bandwidth extension for the first decoded signal and to use a second crossover frequency for the bandwidth extension for the second decoded signal, wherein the first crossover frequency is higher than the second crossover frequency; and a controller for controlling the crossover frequency for the BWE module in accordance with the coding mode information, wherein at least one of the first decoder, the second decoder, the BWE module and the controller comprises a hardware implementation.

2. The apparatus for decoding of claim 1, further comprising an input interface for inputting the encoded audio signal as a bitstream.

3. The apparatus for decoding of claim 1, wherein the BWE module comprises a switch which is configured to switch between the first and second time portion from the first decoder to the second decoder so that the bandwidth extension algorithm is either applied to the first decoded signal or to the second decoded signal.

4. The apparatus for decoding of claim 3, wherein the controller is configured to control the switch dependent on the indicated decoding algorithm within the coding mode information.

5. The apparatus for decoding of claim 1, wherein the controller is configured to increase the crossover frequency within the first time portion or to decrease the crossover frequency within the second time portion.

6. An apparatus for encoding an audio signal comprising:

a first encoder which is configured to encode in accordance with a first encoding algorithm, the first encoding algorithm comprising a first frequency bandwidth, wherein the first encoder comprises an LPC-based coder;

a second encoder which is configured to encode in accordance with a second encoding algorithm, the second encoding algorithm comprising a second frequency bandwidth being smaller than the first frequency bandwidth, wherein the second encoder comprises a transform-based coder;

a decision stage for indicating the first encoding algorithm for a first portion of the audio signal and for indicating the second encoding algorithm for a second portion of the audio signal, the second portion being different from the first portion; and a bandwidth extension module for calculating BWE parameters for the audio signal, wherein the BWE module is configured to be controlled by the decision stage to calculate the BWE parameters for a band not comprising the first frequency bandwidth in the first portion of the audio signal and for a band not comprising the second frequency bandwidth in the second portion of the audio signal, wherein the first or the second frequency bandwidth is defined by a variable crossover frequency and wherein the decision stage is configured to output the variable crossover frequency, wherein the BWE module is configured to use a first crossover frequency for calculating the BWE parameters for a signal encoded using the first encoder and to use a second crossover frequency for a signal encoded using the second encoder, wherein the first crossover frequency is higher than the second crossover frequency.

7. The apparatus for encoding of claim 6, further comprising an output interface for outputting the encoded audio signal, the encoded audio signal comprising a first portion encoded in accordance with a first encoding algorithm, a second portion encoded in accordance with a second encoding algorithm, BWE parameters for the first portion and the second portion and coding mode information indicating the first decoding algorithm or the second decoding algorithm.

8. The apparatus for encoding of claim 6, wherein the first or the second frequency bandwidth is defined by a variable crossover frequency and wherein the decision stage is configured to output the variable crossover frequency.

9. The apparatus for encoding of claim 6, wherein the BWE module comprises a switch controlled by the decision stage, wherein the switch is configured to switch between the first and second time encoder so that the audio signal is for different time portions either encoded by the first or by the second encoder.

10. The apparatus for encoding of claim 6, wherein the decision stage is operative to analyze the audio signal or a first output of the first encoder or a second output of the second encoder or a signal acquired by decoding an output signal of the first encoder or the second encoder with respect to a target function.

11. A method for decoding an encoded audio signal, the encoded audio signal comprising a first portion encoded in accordance with a first encoding algorithm, a second portion encoded in accordance with a second encoding algorithm, BWE parameters for the first portion and the second portion and a coding mode information indicating a first decoding algorithm or a second decoding algorithm, the method comprising:

decoding the first portion in accordance with the first decoding algorithm for a first time portion of the encoded signal to acquire a first decoded signal, wherein decoding the first portion comprises using an LPC-based coder;

decoding the second portion in accordance with the second decoding algorithm for a second time portion of the encoded signal to acquire a second decoded signal, wherein decoding the second portion comprises using a transform-based coder;

performing a bandwidth extension algorithm by a BWE module comprising a controllable crossover frequency, using the first decoded signal and the BWE parameters for the first portion, and performing, by the BWE module comprising the controllable crossover frequency, a bandwidth extension algorithm using the second decoded signal and the bandwidth extension parameter for the second portion, wherein a first crossover frequency is used for the bandwidth extension for the first decoded signal and a second crossover frequency is used for the bandwidth extension for the second decoded signal, wherein the first crossover frequency is higher than the second crossover frequency; and controlling the crossover frequency for the BWE module in accordance with the coding mode information.

12. A method for encoding an audio signal comprising:

encoding in accordance with a first encoding algorithm, the first encoding algorithm comprising a first frequency bandwidth, wherein encoding in accordance with a first encoding algorithm comprises using an LPC-based coder;

encoding in accordance with a second encoding algorithm, the second encoding algorithm comprising a second frequency bandwidth being smaller than the first frequency bandwidth, wherein encoding in accordance with a second encoding algorithm comprises using a transform-based coder;

indicating the first encoding algorithm for a first portion of the audio signal and the second encoding algorithm for a second portion of the audio signal, the second portion being different from the first portion; and calculating BWE parameters for the audio signal such that the BWE parameters are calculated for a band not comprising the first frequency bandwidth in the first portion of the audio signal and for a band not comprising the second frequency bandwidth in the second portion of the audio signal, wherein the first or the second frequency bandwidth is defined by a variable crossover frequency, wherein the BWE module is configured to use a first crossover frequency for calculating the BWE parameters for a signal encoded using the LPC-based coder and to use a second crossover frequency for a signal encoded using the transform-based coder, wherein the first crossover frequency is higher than the second crossover frequency.

13. A non-transitory storage medium having stored thereon a computer program for performing, when running on a computer, the method for encoding an audio signal, said method comprising:

encoding in accordance with a first encoding algorithm, the first encoding algorithm comprising a first frequency bandwidth, wherein encoding in accordance with a first encoding algorithm comprises using an LPC-based coder;

encoding in accordance with a second encoding algorithm, the second encoding algorithm comprising a second frequency bandwidth being smaller than the first frequency bandwidth, wherein encoding in accordance with a second encoding algorithm comprises using a transform-based coder;

indicating the first encoding algorithm for a first portion of the audio signal and the second encoding algorithm for a second portion of the audio signal, the second portion being different from the first portion; and calculating BWE parameters for the audio signal such that the BWE parameters are calculated for a band not comprising the first frequency bandwidth in the first portion of the audio signal and for a band not comprising the second frequency bandwidth in the second portion of the audio signal, wherein the first or the second frequency bandwidth is defined by a variable crossover frequency, wherein the BWE module is configured to use a first crossover frequency for calculating the BWE parameters for a signal encoded using the LPC-based coder and to use a second crossover frequency for a signal encoded using the transform-based coder, wherein the first crossover frequency is higher than the second crossover frequency.

* * * * *